US011501730B2

(12) United States Patent
Park et al.

(10) Patent No.: US 11,501,730 B2
(45) Date of Patent: Nov. 15, 2022

(54) DISPLAY DRIVING APPARATUS AND METHOD CAPABLE OF SUPPLYING FLEXIBLE PORCH SIGNAL IN BLANK PERIOD

(71) Applicant: LX SEMICON CO., LTD., Daejeon (KR)

(72) Inventors: Ho Jong Park, Daejeon (KR); Hyeon Seok Ko, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/509,424

(22) Filed: Oct. 25, 2021

(65) Prior Publication Data

US 2022/0139349 A1 May 5, 2022

(30) Foreign Application Priority Data

Nov. 2, 2020 (KR) ..... 10-2020-0144493

(51) Int. Cl.
*G09G 3/36* (2006.01)

(52) U.S. Cl.
CPC ... *G09G 3/3688* (2013.01); *G09G 2310/0291* (2013.01); *G09G 2310/061* (2013.01); *G09G 2310/08* (2013.01)

(58) Field of Classification Search
CPC ..... G09G 3/36; G09G 3/3611; G09G 3/3614; G09G 3/3622; G09G 3/3625; G09G 3/3674; G09G 3/3677; G09G 3/3681; G09G 3/3688; G09G 3/3692; G09G 2310/0291; G09G 2310/061; G09G 2310/062; G09G 2310/063; G09G 2310/08
USPC ..... 345/87–104
See application file for complete search history.

(56) References Cited

U.S. PATENT DOCUMENTS 6,664,977 B1 * 12/2003 Masumoto ..... G09G 5/006 348/556
2004/0233226 A1 * 11/2004 Toriumi ..... G09G 3/3648 345/100
2007/0030236 A1 * 2/2007 Kim ..... G09G 3/3648 345/98

(Continued)

FOREIGN PATENT DOCUMENTS

KR 10-2005-0019172 A 3/2005
KR 10-2013-0122116 A 11/2013

*Primary Examiner* — Alexander Eisen
*Assistant Examiner* — Nelson Lam
(74) *Attorney, Agent, or Firm* — Harness, Dickey & Pierce, P.L.C.

(57) ABSTRACT

Disclosed is a display driving apparatus configured to provide a signal to a display panel, including an output buffer unit configured to output the source signal to the display panel for the active period and output a porch signal to the display panel for the blank period, and a low dropout (LDO) unit configured to supply the porch signal to the output buffer unit, wherein the output buffer unit includes a buffer configured to output the source signal or the porch signal to the display panel, a first switch configured to switch a connection between the LDO unit and an input line of the buffer, and a second switch configured to switch a connection between the LDO unit and an output line of the buffer, and the buffer is turned on or off according to a switching state of each of the first switch and the second switch.

15 Claims, 7 Drawing Sheets

(56) References Cited

U.S. PATENT DOCUMENTS

| | | | | |
|---|---|---|---|---|
| 2007/0195052 | A1* | 8/2007 | Oh | G09G 3/3688 345/100 |
| 2007/0242011 | A1* | 10/2007 | Kita | G09G 3/3688 345/87 |
| 2008/0180432 | A1* | 7/2008 | Lee | G09G 3/3611 345/214 |
| 2012/0032935 | A1* | 2/2012 | Yen | G09G 3/20 345/204 |
| 2015/0348479 | A1* | 12/2015 | Kim | G09G 3/3406 345/204 |
| 2016/0125798 | A1* | 5/2016 | Park | G09G 3/3208 345/204 |
| 2017/0236485 | A1 | 8/2017 | Lee et al. | |

* cited by examiner

DISPLAY DRIVING APPARATUS AND METHOD CAPABLE OF SUPPLYING FLEXIBLE PORCH SIGNAL IN BLANK PERIOD

CROSS-REFERENCE TO RELATED APPLICATIONS

This application claims the benefit of the Korean Patent Applications No. 10-2020-0144493 filed on Nov. 2, 2020, which are hereby incorporated by reference as if fully set forth herein.

FIELD

The present specification relates to a display driving apparatus and a display driving method.

BACKGROUND

Representative examples of display devices configured to display an image include a liquid crystal display (LCD) device using liquid crystals, an organic light-emitting diode (OLED) display device using OLEDs, and the like.

The display device includes a panel configured to display an image through a pixel array, a panel driver configured to drive the panel, and a timing controller configured to control the panel driver. The panel driver includes a gate driver configured to drive gate lines of the panel, and a data driver configured to drive data lines of the panel.

Once image data is received from an external system, a general timing controller supplies the received image data together with predetermined control information to the data driver. The data driver samples and latches the image data in a digital format according to a predetermined control signal received from the timing controller, converts the image data into a source signal in an analog format, and outputs the source signal to the display panel.

The display panel is driven by being divided into an active period for which the source signal is input and a blank period between the active periods, which is a period for which the source signal is not input. Generally, during the blank period, the data driver supplies a single voltage to the display panel to prevent a leakage current of the display panel. In this case, a problem in which power consumption for driving a display is increased arises.

SUMMARY

The present disclosure is directed to providing a display driving apparatus and method, capable of minimizing power consumption.

The present disclosure is also directed to providing a display driving apparatus and method, capable of preventing a current leakage in a blank period.

The present disclosure is also directed to providing a display driving apparatus and method, capable of rapidly driving a display panel in response to a high frame rate.

The present disclosure is also directed to providing a display driving apparatus and method, capable of supplying a flexible porch signal in each blank period.

The present disclosure is also directed to providing a display driving apparatus and method, capable of reducing a static current generated in a buffer by turning off a buffer in a blank period.

According to an aspect of the present disclosure, there is provided a display driving apparatus configured to provide a signal to a display panel that is driven as an active period in which a source signal corresponding to image data is input and a blank period in which the source signal is not input, including an output buffer unit configured to output the source signal to the display panel for the active period and output a porch signal to the display panel for the blank period, and a low dropout (LDO) unit configured to supply the porch signal to the output buffer unit, wherein the output buffer unit includes a buffer configured to output the source signal or the porch signal to the display panel, a first switch configured to switch a connection between the LDO unit and an input line of the buffer, and a second switch configured to switch a connection between the LDO unit and an output line of the buffer, and the buffer is turned on or off according to a switching state of each of the first switch and the second switch.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
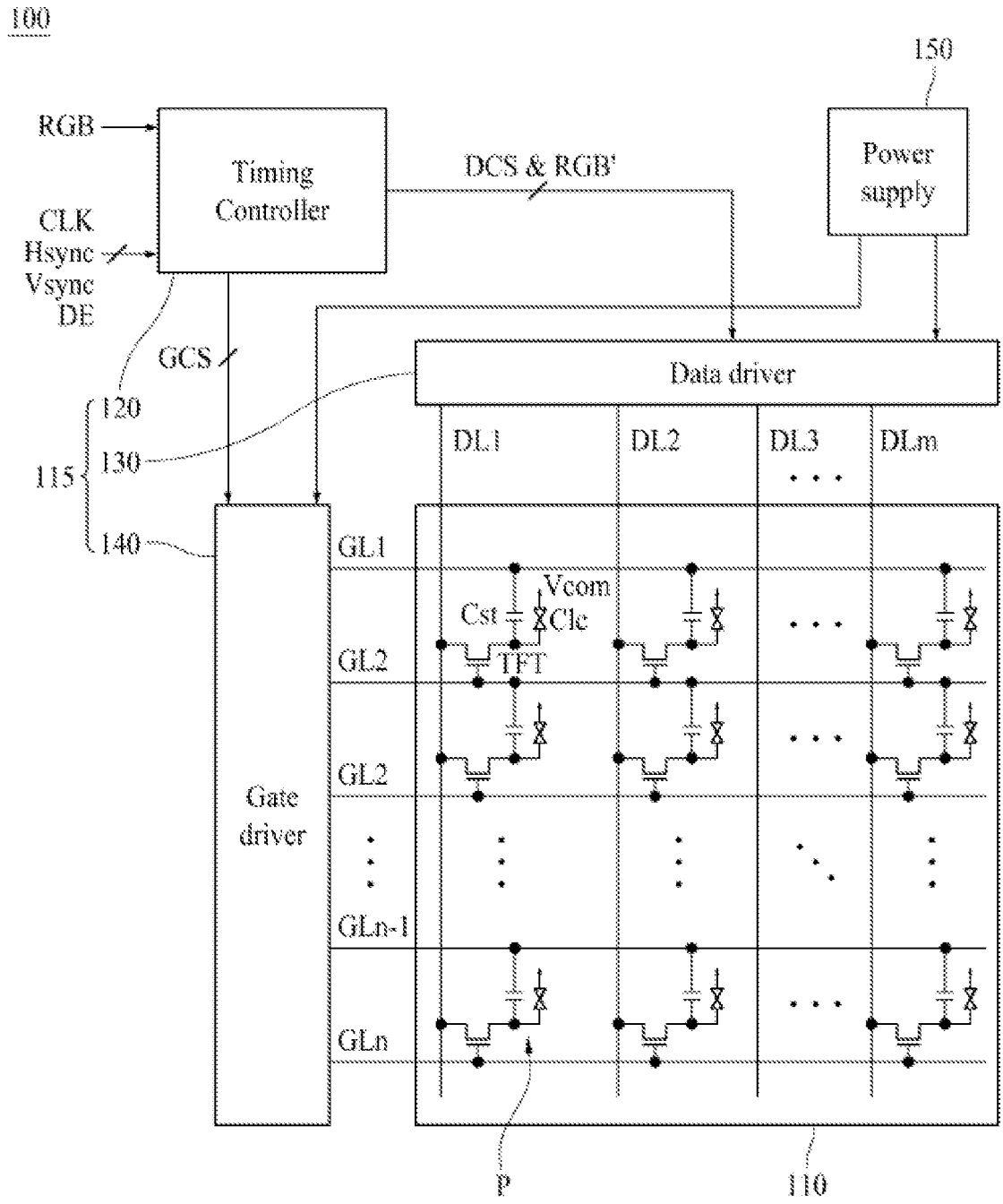
FIG. 1 is a diagram illustrating a configuration of a display system according to one embodiment of the present disclosure.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a time relationship, for example, when the temporal order is described as 'after~', 'subsequent~', 'next~', and 'before~' a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, a display device according to one embodiment of the present disclosure will be described in detail with reference to FIG. 1. FIG. 1 is a diagram illustrating a configuration of a display device according to one embodiment of the present disclosure.

FIG. 1 is a diagram illustrating a display system to which a display driving apparatus according to one embodiment of the present disclosure is applied. As shown in FIG. 1, a display device 100 includes a display panel 110 and a display driving apparatus 115, and the display driving apparatus 115 includes a timing controller 120, a data driver 130, and a gate driver 140.

The display panel 110 includes a plurality of gate lines GL1 to GLn and a plurality of data lines DL1 to DLm, which are arranged to intersect each other and define a plurality of pixel regions, and a pixel P provided in each of the plurality of pixel regions. The plurality of gate lines GL1 to GLn may be arranged in a transverse direction and the plurality of data lines DL1 to DLm may be arranged in a longitudinal direction, but the present disclosure is not necessarily limited thereto.

The display panel 110 may be a liquid crystal display (LCD) panel. When the display panel 110 is an LCD panel, the display panel 110 includes thin-film transistors (TFTs) and liquid crystal cells connected to the TFTs, which are formed in pixel regions defined by the plurality of gate lines GL1 to GLn and the plurality of data lines DL1 to DLm.

The TFT transmits a data signal supplied through the data lines DL1 to DLm to the liquid crystal cell in response to a scan pulse supplied through the gate lines GL1 to GLn.

The liquid crystal cell is composed of a common electrode and a sub-pixel electrode, which is connected to the TFT, facing each other with a liquid crystal therebetween and thus may be equivalently expressed as a liquid crystal capacitor Clc. The liquid crystal cell includes a storage capacitor Cst connected to the gate line of a previous stage in order to maintain a voltage corresponding to the source signal charged in the liquid crystal capacitor Clc until a voltage corresponding to a next source signal is charged.

Meanwhile, the pixel regions of the display panel 110 may include red (R), green (G), blue (B), and white (W) subpixels. Each of the subpixels may be repeatedly formed in a row direction or formed in a matrix form of 2×2. In this case, a color filter corresponding to each color is disposed in each of the red (R), green (G), and blue (B) subpixels, but a separate color filter is not disposed in the white (W) subpixel. In one embodiment, the red (R), green (G), blue (B), and white (W) subpixels may be formed to have the same area ratio but may also be formed to have different area ratios.

Further, the display panel 110 is described as being an LCD panel, but the display panel 110 may be an organic light-emitting diode (OLED) display panel in which an OLED is formed in each pixel region.

The timing controller 120 receives various timing signals including a vertical synchronization signal Vsync, a horizontal synchronization signal Hsync, a data enable signal DE, a clock signal CLK, and the like from an external system (not shown) and generates a data control signal DCS for controlling the data driver 130 and a gate control signal GCS for controlling the gate driver 140. In addition, the timing controller 120 receives image data RGB from the external system, converts the received image data RGB into image data RGB' in a form that can be processed by the data driver 130, and outputs the converted image data RGB'.

The data control signal DCS may include a source start pulse SSP, a source sampling clock SSC, a source output enable signal SOE, and the like, and the gate control signal GCS may include a gate start pulse GSP, a gate shift clock GSC, a gate output enable signal GOE, and the like.

Here, the source start pulse controls a data sampling start timing of n source driver integrated circuits (ICs) (not shown) which configure the data driver 130. The source sampling clock is a clock signal which controls a sampling timing of data in each of the source driver ICs. The source output enable signal controls an output timing of each of the source driver ICs.

The timing controller 120 generates the gate control signal GCS including the gate start pulse GSP, the gate shift clock GSC, and the gate output enable signal GOE.

The gate start pulse controls an operation start timing of the m gate driver ICs (not shown) which configure the gate driver 140. The gate shift clock is a clock signal which is commonly input to one or more gate driver ICs and controls a shift timing of a scan signal (gate pulse). The gate output enable signal designates timing information of one or more gate driver ICs.

The timing controller 120 aligns the image data RGB received from the external system. Specifically, the timing controller 120 aligns the image data RGB' to match the structure and characteristics of the display panel 110. The timing controller 120 transmits the aligned image data RGB' to the data driver 130.

In one embodiment of the present disclosure, the timing controller 120 may output a signal for controlling a first switch 135*b* and a second switch 135*c* of an output buffer unit 135, which will be described below. The timing controller 120 may output a control signal for periodically turning the first switch 135*b* and the second switch 135*c* on or off. For example, the timing controller 120 may output a signal for controlling the first switch 135*b* and the second switch 135*c* according to the data enable signal DE.

The gate driver 140 outputs a gate signal, which is synchronized with the source signal generated by the data driver 130, to the gate line according to the timing signal generated by the timing controller 120. Specifically, the gate driver 140 outputs the gate signal, which is synchronized with the source signal, to the gate line according to the gate start pulse, the gate shift clock, and the gate output enable signal that are generated by the timing controller 120.

The gate driver 140 includes a gate shift register circuit, a gate level shifter circuit, and the like. Here, the gate shift register circuit may be formed directly on a TFT array substrate of the display panel 110 by a gate-in-panel (GIP) process. In this case, the gate driver 140 supplies the gate start pulse and the gate shift clock to the gate shift register that is formed on the TFT array substrate by a GIP process.

The data driver 130 converts the aligned image data RGB' into the source signal according to the timing signal generated by the timing controller 120. Specifically, the data driver 130 converts the aligned image data RGB' into the source signal according to the source start pulse, the source sampling clock, and the source output enable signal. The data driver 130 outputs the source signals corresponding to one horizontal line to the data lines every one horizontal period at which the gate signal is supplied to the gate lines. Here, the data driver 130 may receive a gamma voltage from a gamma voltage generator (not shown) and convert the aligned image data RGB' into the source signals using the gamma voltage. The data driver 130 according to one embodiment of the present disclosure will be described in detail with reference to FIGS. 2 and 3.

Figure 2:
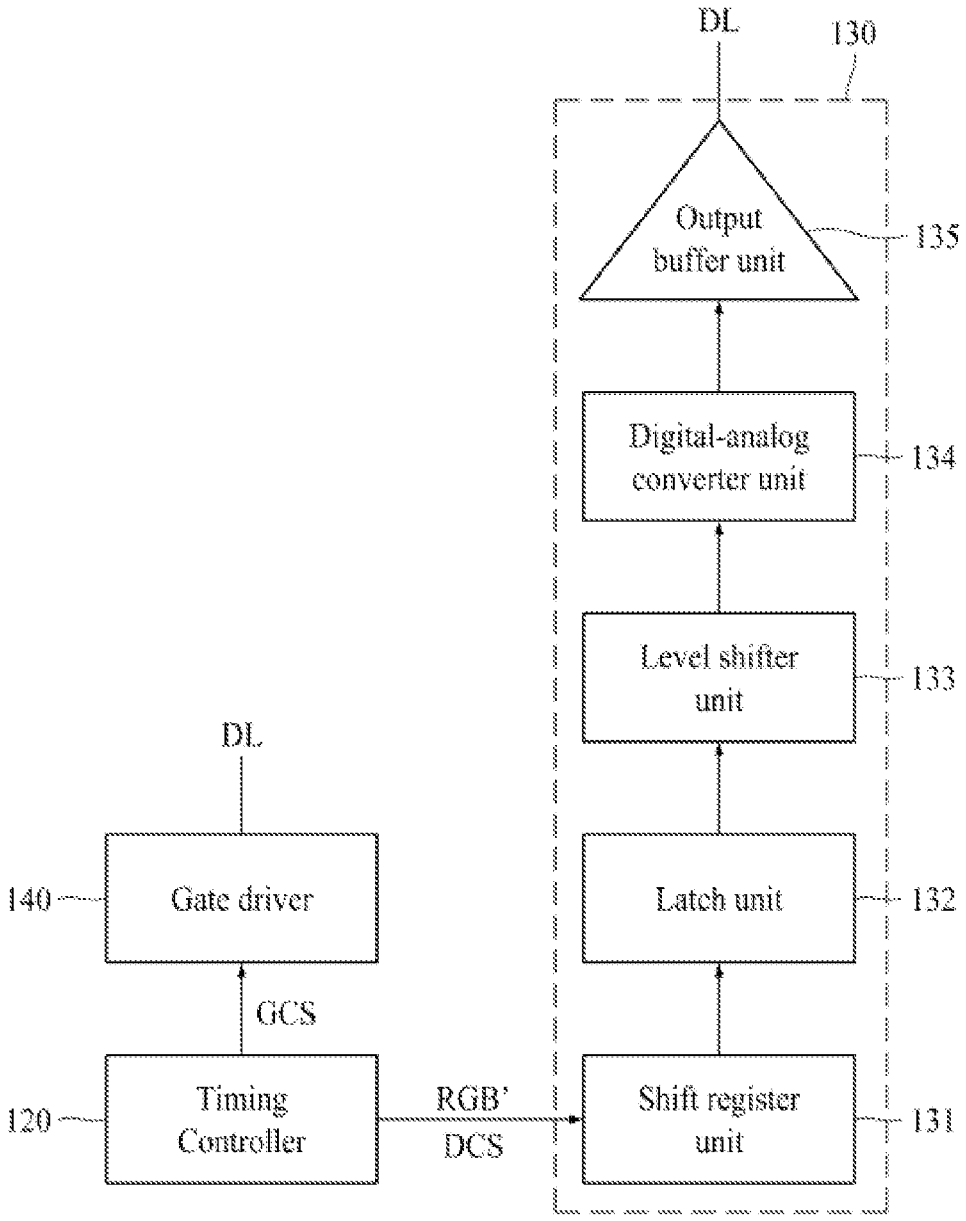
FIG. 2 is a schematic block diagram of a data driver according to one embodiment of the present disclosure.
Figure 3:
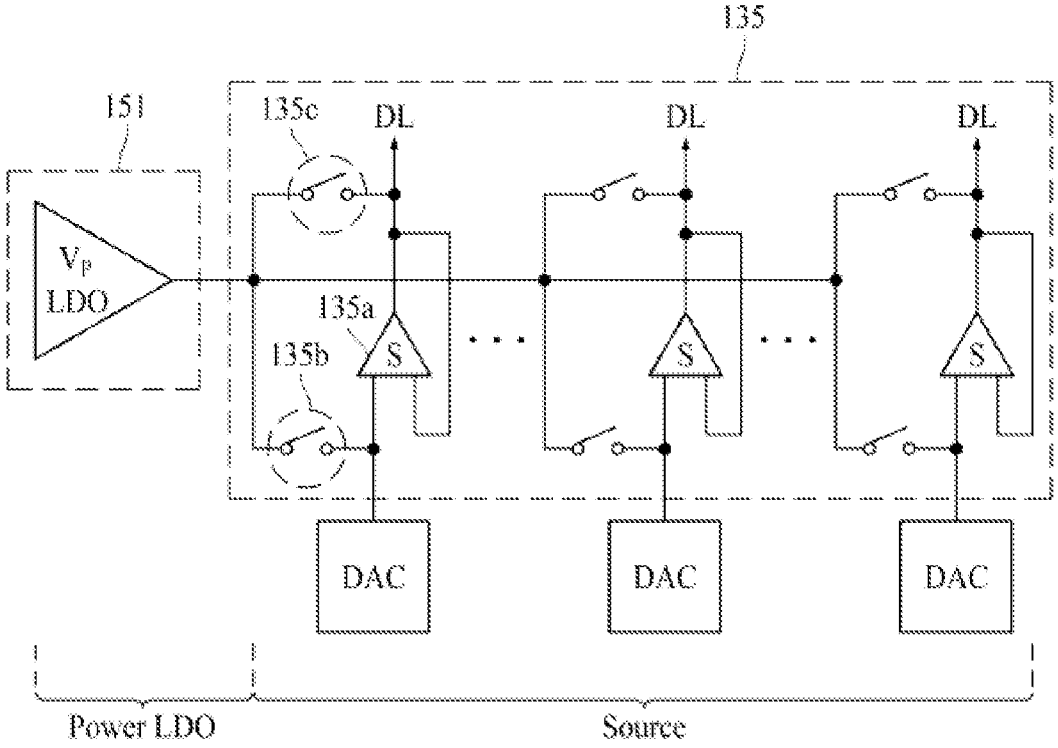
FIG. 3 is a circuit diagram illustrating a portion of the data driver according to one embodiment of the present disclosure.

A power supply 150 generates various voltages necessary for the gate driver 140 and the data driver 130. For example, the power supply 150 generates an analog power source and a digital power source by boosting or dropping a system voltage. The analog power source may include a reference voltage, a common voltage, a gamma voltage, a gate high voltage, a gate low voltage, and the like, and the digital power source may include a digital logic voltage and the like. Hereinafter, the data driver according to one embodiment of the present disclosure will be described in detail with reference to FIGS. 2 and 3. FIG. 2 is a schematic block diagram of the data driver according to one embodiment of the present disclosure, and FIG. 3 is a circuit diagram illustrating a low dropout (LDO) unit and an output buffer unit according to one embodiment of the present disclosure.

The data driver 130 converts the aligned image data RGB' into the source signal according to the timing signal generated by the timing controller 120.

To this end, as shown in FIG. 2, the data driver 130 includes a shift register unit 131, a latch unit 132, a level shifter unit 133, a digital-analog converter unit 134, and an output buffer unit 135.

The shift register unit 131 receives the source start pulse and the source sampling clock from the timing controller 120 and sequentially shifts the source start pulse according to the source sampling clock to output a sampling signal. The shift register unit 131 transmits the sampling signal to the latch unit 132.

The latch unit 132 sequentially samples and latches the image data, by predetermined units, according to the sampling signal. The latch unit 132 transmits the latched image data to the level shifter unit 133.

The level shifter unit 133 amplifies a level of the latched image data. Specifically, the level shifter unit 133 amplifies the level of the image data to a level at which the digital-analog converter unit 134 may be driven. The level shifter unit 133 transmits the image data, whose level is amplified, to the digital-analog converter unit 134.

The digital-analog converter unit 134 converts the image data into the source signal that is an analog signal. The digital-analog converter unit 134 transmits the source signal converted into an analog signal to the output buffer unit 135.

The output buffer unit 135 according to one embodiment of the present disclosure outputs the source signal or a porch signal to the data line DL according to switching operations of switching units 135*b* and 135*c* which will be described later. Specifically, the output buffer unit 135 may buffer and output the source signal to the data line DL or output the porch signal received from the LDO unit 151 of the power supply 150 to the data lines DL according to the source output enable signal generated by the timing controller 120.

As described above, the display panel 110 displays an image including a periodic frame according to the vertical synchronization signal Vsync, the horizontal synchronization signal Hsync, the data enable signal DE, and the clock signal CLK input to the timing controller 120.

As shown in FIG. 3, the output buffer unit 135 according to one embodiment of the present disclosure includes a buffer 135*a* and the switching units 135*b* and 135*c*.

According to one embodiment of the present disclosure, the buffer 135*a* is turned on or off according to switching operations of the switching units 135*b* and 135*c* to be described later.

According to switching states of the switching units 135*b* and 135*c*, the buffer 135*a* receives the source signal through an input line or receives the porch signal from the LDO unit 151, buffers the received signal, and outputs the buffered signal through an output line.

The switching units 135*b* and 135*c* include the first switch 135*b* and the second switch 135*c* connecting the LDO unit 151 and the buffer 135*a*. Specifically, the first switch 135*b* switches the connection between the LDO unit 151 and the input line of the buffer 135*a*, and the second switch 135*c* switches the connection between the LDO unit 151 and the output line of the buffer 135*a*.

In one embodiment of the present disclosure, when the first switch 135*b* is turned on and the second switch 135*c* is turned off, the buffer 135*a* is turned on and the porch signal output from the LDO unit 151 is input to the input line of the buffer 135*a*. Accordingly, the output buffer unit 135 buffers a porch signal $V_p$ input from the LDO unit 151 and outputs the buffered porch signal $V_p$ to the data line DL.

In one embodiment of the present disclosure, the switching states of the switching units 135*b* and 135*c* may be controlled according to the control signal output from the timing controller 120. For example, the switching units 135*b* and 135*c* receive signals for controlling the switching units 135*b* and 135*c* according to the data enable signal DE from the timing controller 120, and the switching units 135*b* and 135*c* may be turned on or off periodically. However, the present disclosure is not limited thereto, and the switching units 135*b* and 135*c* may be turned on or off periodically without a separate control signal.

According to one embodiment of the present disclosure, since the output buffer unit 135 outputs the received porch signal to the data line DL through the buffer 135*a*, the output buffer unit 135 may rapidly drive the display panel in response to a high frame rate.

In one embodiment of the present disclosure, when the first switch 135*b* is turned off and the second switch 135*c* is turned on, the buffer 135*a* is turned off and the porch signal $V_p$ output from the LDO unit 151 is input to the output line of the buffer 135*a*. Accordingly, the output buffer unit 135 outputs the porch signal $V_p$ input from the LDO unit 151 to the data lines DL.

According to one embodiment of the present disclosure, since the buffer 135*a* is turned off during a portion of a blank period, power consumed by the output buffer unit 135 to drive the display panel may be reduced.

According to one embodiment of the present disclosure, even when the buffer 135*a* is turned off, the output buffer unit 135 outputs the porch signal $V_p$ input from the LDO unit 151 to the data line DL to prevent a leakage current of the display panel 110 and to reduce a static current of the buffer 135*a*.

According to one embodiment of the present disclosure, the porch signal $V_p$ may have an intermediate value in a range of the source signal. In addition, the porch signal $V_p$ may vary depending on the amount of leakage current of the display panel 110.

According to one embodiment of the present disclosure, the first and second switches 135*b* and 135*c* may be switched periodically. For example, the first switch 135*b* is turned on at a time point at which the data enable signal DE input to the timing controller 120 ends, and maintains the turned-on state for a period for which one horizontal line is input, and the second switch 135*c* is turned on at a time point at which the first switch 135*b* is turned off, and maintains the turned-on state until a time point at which the data enable signal DE input to the timing controller 120 starts. This will be described in detail with reference to FIGS. 4 to 6.

When both the first switch 135*b* and the second switch 135*c* are turned off, the buffer 135*a* is turned on and the source signal is input from the digital-analog converter unit 134 to the input line of the buffer 135*a*. Accordingly, the output buffer unit 135 buffers the source signal input from the digital-analog converter unit 134 and outputs the buffered source signal to the data line DL.

According to one embodiment of the present disclosure, the LDO unit 151 is connected to the output buffer unit 135 and supplies the porch signal to the output buffer unit 135. Specifically, the LDO unit 151 is connected to the input line of the buffer 135*a* through the first switch 135*b* and is connected to the output line of the buffer 135*a* through the second switch 135*c*. That is, according to the switching states of the first switch 135*b* and the second switch 135*c*, the buffer 135*a* is turned on or off and the LDO unit 151 supplies the porch signal to the input line or the output line of the buffer 135*a*.

The LDO unit 151 may be included in the above-described power supply 150 and may supply the porch signal to the output buffer unit 135. However, the present disclosure is not limited thereto, and the LDO unit 151 may be included in the output buffer unit 135, may receive a voltage supplied from the power supply 150 to the data driver 130, and may generate the porch signal and supply the porch signal to the output buffer unit 135.

The switching operations of the first switch 135*b* and the second switch 135*c* and the signal output from the output buffer unit 135 accordingly will be described below with reference to FIGS. 4 to 5C.

Hereinafter, a method of driving a display according to one embodiment and another embodiment of the present disclosure will be described in detail with reference to FIGS. 4 to 6. FIG. 4 is a timing diagram illustrating a method of driving the display panel according to one embodiment of the present disclosure, and FIGS. 5A to 5C are circuit diagrams illustrating operation processes of the output buffer unit according to one embodiment of the present disclosure. FIG. 6 is a timing diagram illustrating a method of driving a display panel according to another embodiment of the present disclosure.

The display panel 110 displays an image including a periodic frame according to a vertical synchronization signal Vsync, a horizontal synchronization signal Hsync, a data enable signal DE, and a clock signal CLK input to the timing controller 120. Specifically, as shown in FIG. 4, the display panel 110 is driven by being divided into an active period ACTIVE and a blank period BLANK according to the data enable signal DE. Specifically, as shown in FIG. 4, the data driver 130 outputs a source signal IMG or a porch signal $V_p$ according to the data enable signal DE. For example, when the data enable signal DE is high, the data driver 130 may output the source signal IMG to drive the display panel 110 as the active period ACTIVE, and when the data enable signal DE is low, the data driver 130 may output the porch signal $V_p$ to drive the display panel 110 as the blank period BLANK. At this point, the blank period BLANK may include a first porch period PT1 driven in a first porch mode PM1 and a second porch period PT2 driven in a second porch mode PM2.

Figure 4:
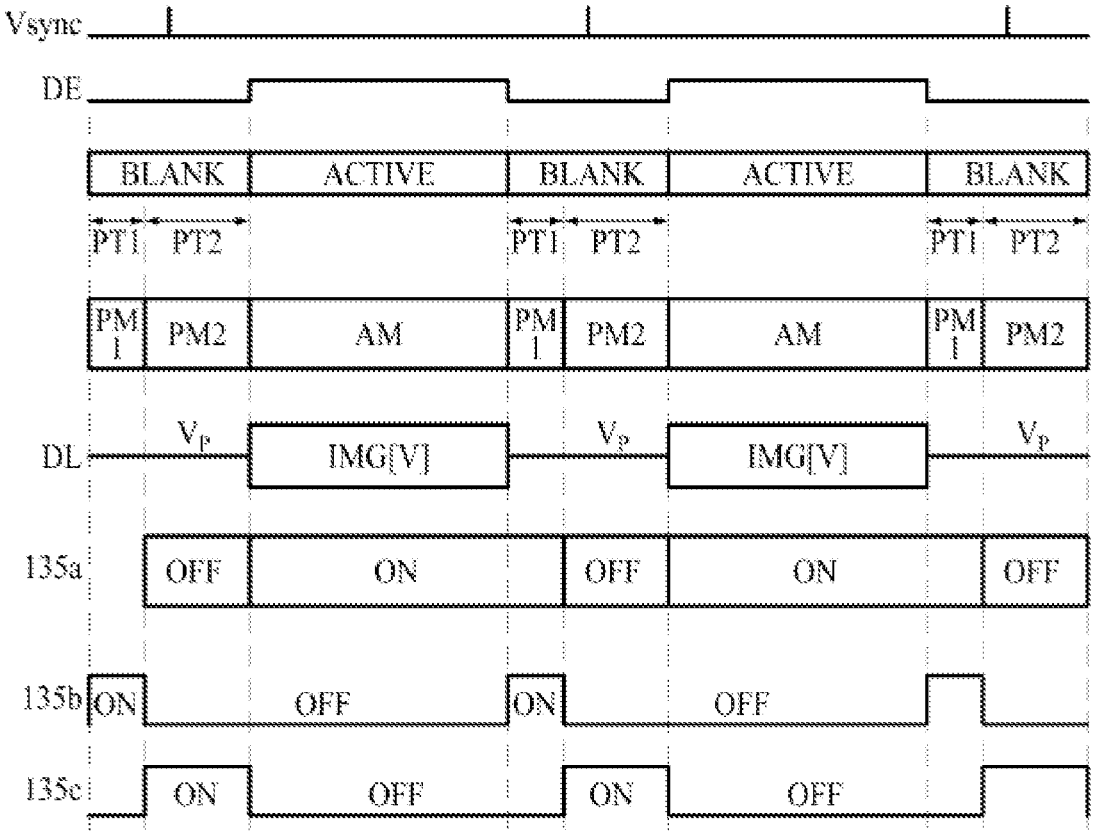
FIG. 4 is a timing diagram illustrating a method of driving a display panel according to one embodiment of the present disclosure.
Figure 5A:
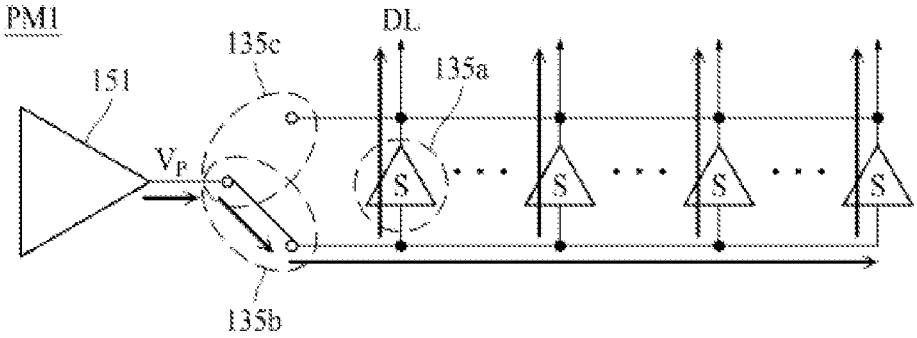
FIGS. 5A, 5B and 5C are circuit diagrams illustrating operation processes of the data driver according to one embodiment of the present disclosure.
Figure 6:
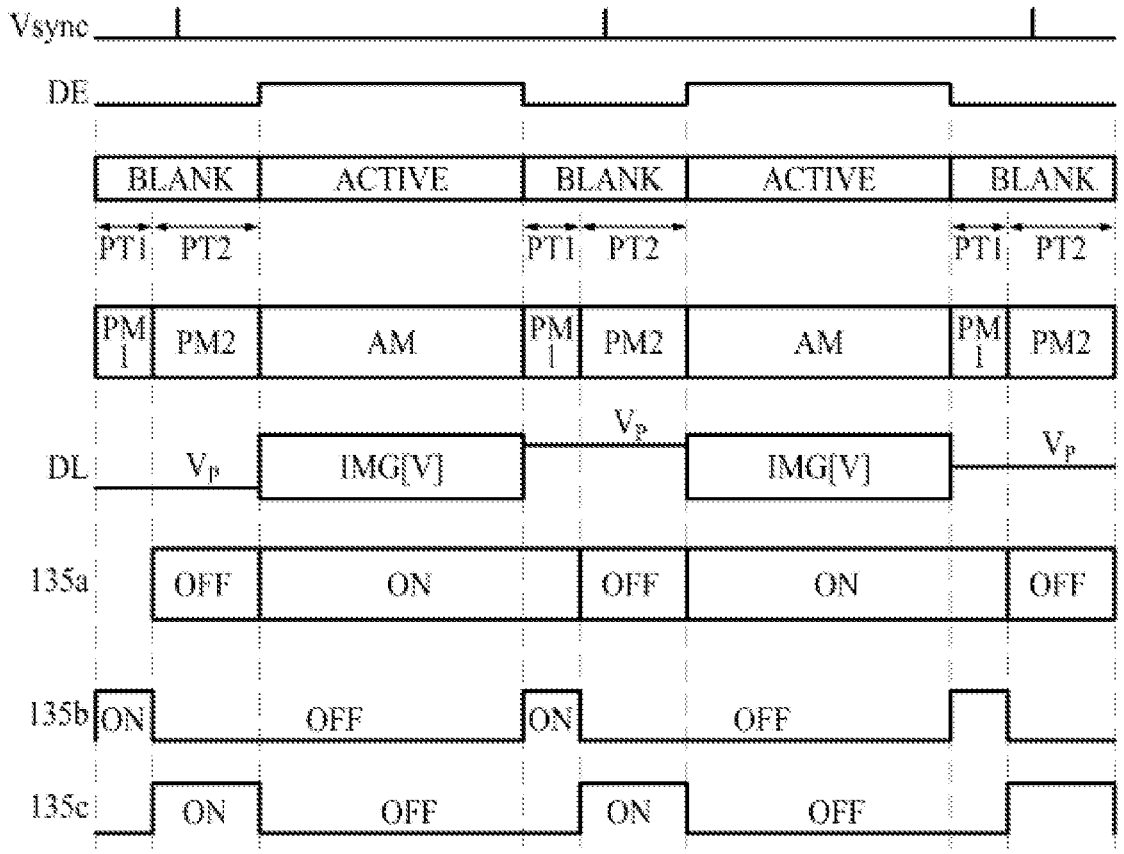
FIG. 6 is a timing diagram illustrating a method of driving a display panel according to another embodiment of the present disclosure.

As shown in FIGS. 4 and 5A, the first switch 135*b* is turned on and the second switch 135*c* is turned off in the first porch mode PM1, and the output buffer unit 135 outputs the porch signal $V_p$ buffered by the buffer 135*a*. Specifically, the first switch 135*b* is turned on in the first porch mode PM1 and thus the LDO unit 151 is connected to the input line of the buffer 135*a*, and the second switch 135*c* is turned off and thus the LDO unit 151 is not connected to the output line of the buffer 135*a*. Accordingly, the buffer 135*a* is turned on and receives the porch signal $V_p$ from the LDO unit 151 through the input line, buffers the received porch signal, and outputs the buffered porch signal to the data line DL.

The first switch 135*b* is turned on at a time point at which the data enable signal DE ends. At this point, the data enable signal DE is a signal periodically output, and the first switch 135*b* is periodically turned on according to the data enable signal DE. For example, the first switch 135*b* may be turned on at a time point at which the data enable signal DE ends and may be turned off after maintaining the turned-on state for one horizontal period.

According to one embodiment of the present disclosure, since the output buffer unit 135 outputs the received porch signal $V_p$ to the data line DL through the buffer 135*a*, the output buffer unit 135 may be quickly driven in response to an image of a high frame rate.

Figure 5B:
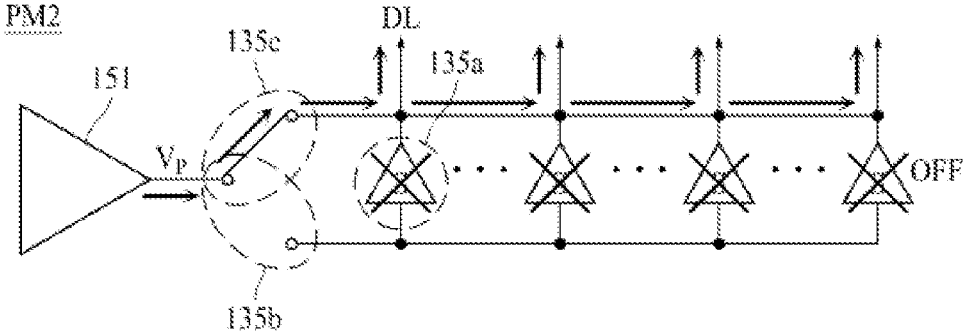

As shown in FIGS. 4 and 5B, the first switch 135*b* is turned off and the second switch 135*c* is turned on in the second porch mode PM2, and the output buffer unit 135 outputs the porch signal $V_p$ input from the LDO unit 151. Specifically, the first switch 135*b* is turned off in the second porch mode PM2 and thus the LDO unit 151 is not connected to the input line of the buffer 135*a*, and the second switch 135*c* is turned on and thus the LDO unit 151 is connected to the output line of the buffer 135*a*. Accordingly, the buffer 135*a* is turned off and the output buffer unit 135 receives the porch signal $V_p$ from the LDO unit 151 through the output line of the buffer 135*a* and outputs the input porch signal $V_p$ to the data line DL. At this point, the porch signal $V_p$ may have an intermediate value in a range of the source signal IMG, and the porch signal $V_p$ has the same value in the first and second porch modes PM1 and PM2. In addition, as shown in FIG. 6, the porch signal $V_p$ may have different values in the first porch modes PM1, which are different from each other, or in the second porch modes PM2 that are different from each other. The porch signal $V_p$ may vary depending on the amount of the leakage current of the display panel 110. Accordingly, the output buffer unit 135 supplies the porch signal $V_p$ to the display panel 110 in the first and second porch modes PM1 and PM2, thereby preventing the leakage current of the display panel 110.

According to one embodiment of the present disclosure, since the buffer 135*a* is turned off in the second porch mode PM2, the power consumed by the output buffer unit 135 may be reduced.

As shown in FIG. 4, the second switch 135*c* is turned on according to the switching state of the first switch 135*b* and is turned off according to the data enable signal DE. Specifically, the second switch 135*c* is turned on at a time point at which the first switch 135*b* is turned off and is turned off at a time point at which the data enable signal DE starts. For example, when the first switch 135*b* is turned on for one horizontal period from a time point at which the data enable signal DE ends and then turned off, the second switch 153*c* may be turned on, maintain the turned-on state until a time point at which the data enable signal DE starts, and then may be turned off.

According to one embodiment of the present disclosure, even when the buffer 135*a* is turned off, the output buffer unit 135 outputs the porch signal $V_p$ input from the LDO unit 151 to the data line DL, thereby preventing the leakage current of the display panel 110 and reducing the static current of the buffer 135*a*.

According to one embodiment of the present disclosure, the data driver 130 operates in an active mode AM in the active period ACTIVE for which the source signal IMG is input to the display panel 110.

The data driver 130 operates in the active mode AM and buffers the source signal IMG input from the digital-analog converter unit 134 and outputs the buffered source signal IMG to the data line DL.

Figure 5C:
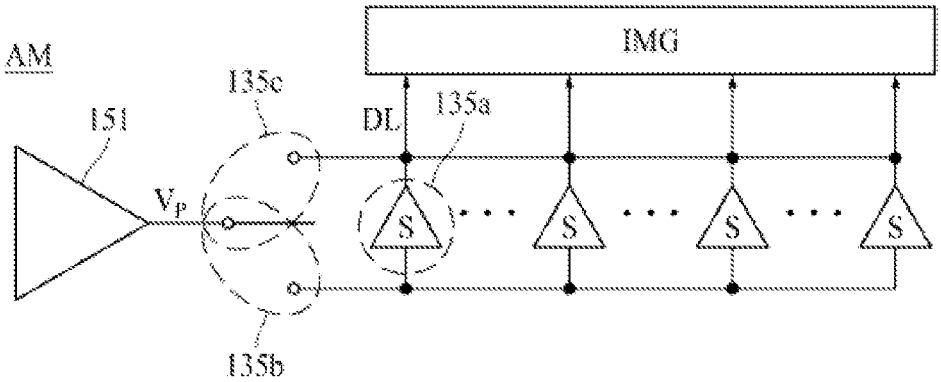

As shown in FIGS. 4 and 5C, the first switch 135*b* and the second switch 135*c* are turned off in the active mode AM, and the output buffer unit 135 outputs the source signal IMG buffered by the buffer 135*a*. Specifically, in the active mode AM, both the first switch 135*b* and the second switch 135*c* are turned off, and thus the LDO unit 151 is not connected to the input and output lines of the buffer 135*a*. Accordingly, the buffer 135*a* is turned on to receive the source signal IMG from the digital-analog converter unit 134 through the input line of the buffer 135*a*, buffer the received source signal IMG, and output the buffered source signal IMG to the data line DL.

Figure 7:
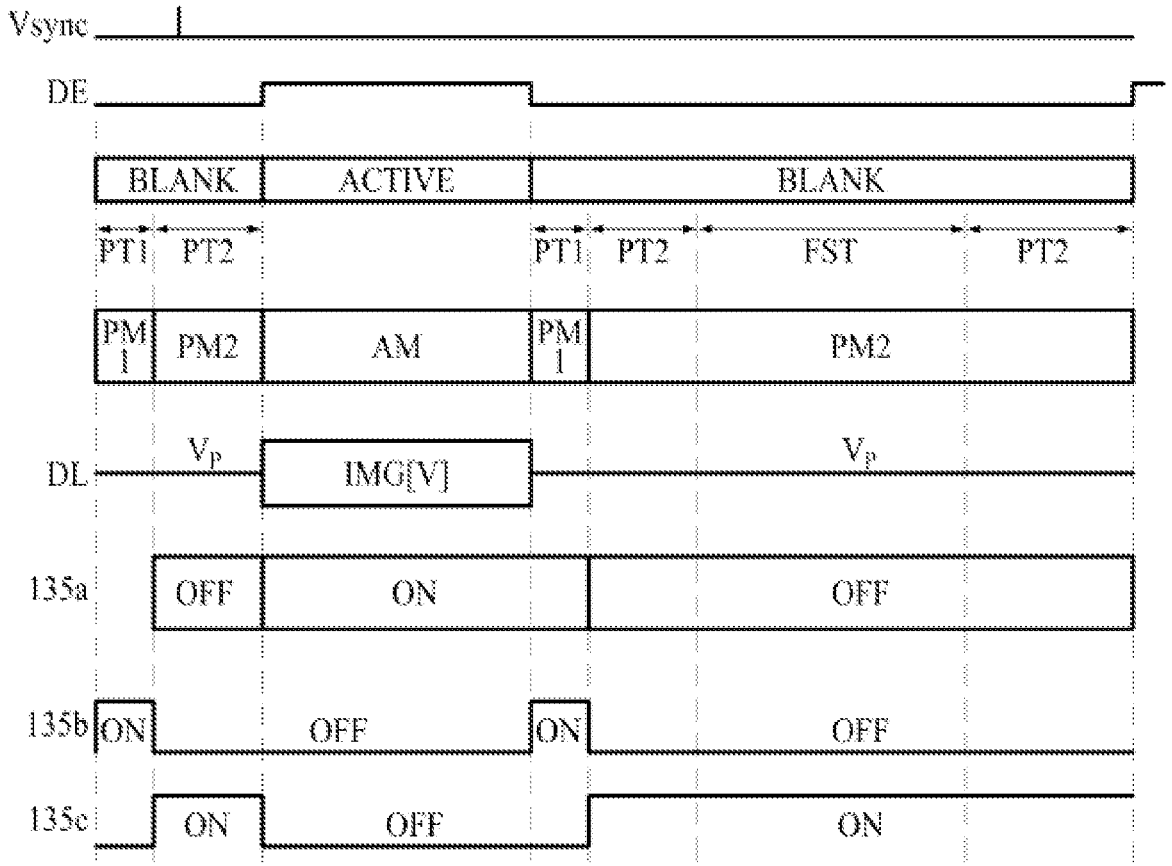
FIG. 7 is a timing diagram illustrating a method of driving a display panel according to still another embodiment of the present disclosure.

Hereinafter, a method of driving a display according to still another embodiment of the present disclosure will be described in detail with reference to FIG. 7. FIG. 7 is a timing diagram illustrating a method of driving a display panel according to still another embodiment of the present disclosure.

Referring to FIG. 7, the display panel 110 receives a source signal IMG or a porch signal $V_p$ according to a data enable signal DE. The display panel 110 is driven as an active period ACTIVE for which the source signal IMG is received according to the data enable signal DE and a blank period BLANK, which are between the active periods ACTIVE, for which a porch signal $V_p$ is received. For example, the display panel 110 may receive the source signal IMG when the data enable signal DE is high to be driven as the active period ACTIVE and may receive the porch signal when the data enable signal DE is low to be driven as the blank period BLANK. To this end, the data driver 130 outputs the source signal IMG or the porch signal $V_p$ according to the data enable signal DE. The data driver 130 outputs the source signal IMG in the active period ACTIVE and outputs the porch signal $V_p$ in the blank period BLANK.

According to still another embodiment of the present disclosure, the blank period BLANK may include a first porch period PT1 driven in a first porch mode PM1, a second porch period PT2 driven in a second porch mode PM2, and a frame skip period FST driven in the second porch mode PM2. The frame skip period FST is a period in which the same image as the source signal IMG input in the previous active period ACTIVE is displayed, and thus a separate new source signal is not input. Accordingly, the data driver 130 is driven in the second porch mode PM2 in the frame skip period FST as driven in the second porch mode PM2 in the second porch period PT2 immediately before the frame skip period FST. That is, during the frame skip period FST, the data driver 130 is driven by being maintained in the second porch mode PM2 immediately before the frame skip period FST. In addition, according to still another embodiment of the present disclosure, the data driver 130 is driven not only when the second porch mode PM2 is the frame skip period FST but also until the data enable signal DE is input.

According to the present disclosure, a data driver can supply a porch signal to a display panel in a blank period so that there is an effect of preventing current from leaking from the display panel.

Further, according to the present disclosure, there is an effect that a display panel can be rapidly driven and can display an image even when a frame rate of the image is high.

Further, according to the present disclosure, a porch signal can be changed in each blank period so that there is an effect of preventing a leakage current which is changed in a display panel.

Further, according to the present disclosure, a buffer can be turned off in a portion of a blank period so that there is an effect of reducing a static current of the buffer.

Therefore, it should be understood that the above-described embodiments are not restrictive but illustrative in all aspects. The scope of the present disclosure is defined by the appended claims rather than the detailed description, and it should be construed that all alternations or modifications derived from the meaning and scope of the appended claims and the equivalents thereof fall within the scope of the present disclosure.

What is claimed is:

1. A display driving apparatus configured to provide a signal to a display panel that is driven as an active period in which a source signal corresponding to image data is input and a blank period in which the source signal is not input, the display driving apparatus comprising:

an output buffer unit configured to output the source signal to the display panel for the active period and output a porch signal to the display panel for the blank period; and a low dropout (LDO) unit configured to supply the porch signal to the output buffer unit, wherein the output buffer unit includes a buffer configured to output the source signal or the porch signal to the display panel, a first switch configured to switch a connection between the LDO unit and an input line of the buffer, and a second switch configured to switch a connection between the LDO unit and an output line of the buffer, the buffer is turned on or off according to a switching state of each of the first switch and the second switch, the output buffer unit is configured to output the porch signal when one of the first switch and the second switch is turned on, and the output buffer unit is configured to output the source signal when both the first switch and the second switch are turned off.

2. The display driving apparatus of claim 1, wherein the buffer is turned on when the first switch is turned on and the second switch is turned off, and the buffer is turned off when the first switch is turned off and the second switch is turned on.

3. The display driving apparatus of claim 1, wherein the output buffer unit receives the porch signal from the LDO unit, and buffers and outputs the received porch signal when the first switch is turned on and the second switch is turned off, and the output buffer unit outputs the porch signal received from the LDO unit when the first switch is turned off and the second switch is turned on.

4. The display driving apparatus of claim 1, wherein, when the first switch is turned off and the second switch is turned off, the buffer is turned on to receive the source signal from a digital-analog converter connected to the input line of the buffer, and buffer and output the received source signal.

5. The display driving apparatus of claim 1, wherein the porch signal has an intermediate value in a range of the source signal.

6. The display driving apparatus of claim 1, wherein when the first switch is turned on and the second switch is turned off, the output buffer unit operates in a first porch mode in which the buffer is turned on and outputs the porch signal, when the first switch is turned off and the second switch is turned on, the output buffer unit operates in a second porch mode in which the buffer is turned off and outputs the porch signal, and the porch signal has a same value in the first porch mode and the second porch mode of the output buffer unit and has different values in the first porch modes, which are different from each other, and the second porch modes, which are different from each other, of the output buffer unit.

7. The display driving apparatus of claim 6, wherein the blank period includes a first porch period, a second porch period, and a frame skip period, and the output buffer unit is driven in the first porch mode for the first porch period and is driven in the second porch mode for the frame skip period and the second porch period.

8. The display driving apparatus of claim 1, wherein the first switch is periodically turned on according to a data enable signal that enables the source signal to be input to the display panel.

9. The display driving apparatus of claim 1, wherein the second switch is turned on at a time point at which the first switch is turned off and is turned off at a time point at which a data enable signal, which enables the source signal to be input to the display panel, starts.

10. A display driving method of providing a signal to a display panel that is driven as an active period in which a source signal corresponding to image data is input and a blank period in which the source signal is not input, the method comprising:

an operation in which an output buffer unit operates in a first porch mode so that a buffer is turned on, and the output buffer unit outputs a porch signal to the display panel;

an operation in which the output buffer unit operates in a second porch mode so that the buffer of the output buffer unit is turned off, and the output buffer unit outputs the porch signal to the display panel; and an operation in which the output buffer unit operates in an active mode so that the buffer of the output buffer unit is turned on, and the output buffer unit outputs the source signal having pixel information to the display panel, wherein a first switch of the output buffer unit is turned on and a second switch of the output buffer unit is turned off in the operation in which the output buffer unit operates in the first porch mode, the first switch is turned off and the second switch is turned on in the operation in which the output buffer unit operates in the second porch mode, and the first switch is turned off and the second switch is turned off in the operation in which the output buffer unit operates in the active mode.

11. The method of claim 10, wherein the second switch is turned on according to a switching state of the first switch, and the second switch is periodically turned off according to a data enable signal that enables the source signal to be input to the display panel.

12. The method of claim 10, wherein a first switch of the output buffer unit is periodically turned on according to a data enable signal that enables the source signal to be input to the display panel.

13. The method of claim 10, wherein the porch signal has an intermediate value in a voltage range of the source signal.

14. The method of claim 10, wherein the porch signal has a same value in the first porch mode and the second porch mode of the output buffer unit and has different values in the first porch modes, which are different from each other, and the second porch modes, which are different from each other, of the output buffer unit.

15. The method of claim 10, wherein the display panel is driven as a first porch period in the operation in which the output buffer unit operates in the first porch mode, and the display panel is driven as the second porch period and a frame skip period in the operation in which the output buffer unit operates in the second porch mode.

* * * * *